United States Patent [19]

Morgan et al.

[11] Patent Number: 4,974,977

[45] Date of Patent: Dec. 4, 1990

[54] PRINT RIBBON CARTRIDGE WITH VACUUM BUFFER CHAMBERS

[75] Inventors: Robert S. Morgan, Yukon; Douglas E. Thompson, Oklahoma City, both of Okla.

[73] Assignee: BancTec, Inc., Dallas, Tex.

[21] Appl. No.: 300,474

[22] Filed: Jan. 19, 1989

[51] Int. Cl.[5] ..... B41J 35/28

[52] U.S. Cl. ..... 400/208; 400/234; 400/245; 242/182

[58] Field of Search ..... 400/176, 207, 208, 208.1, 400/225, 234, 245, 248, 248.3, 249; 242/182, 183

[56] References Cited

U.S. PATENT DOCUMENTS

| | | | |
|---|---|---|---|
| 2,919,785 | 1/1960 | Newman et al. | 400/248.3 |
| 2,998,878 | 9/1961 | Biedinger et al. | 400/245 |
| 3,952,968 | 4/1976 | McKinstry et al. | 242/182 |
| 4,265,551 | 5/1981 | Adamek et al. | 400/245 X |
| 4,313,683 | 2/1982 | Brown et al. | 400/234 X |
| 4,747,715 | 5/1988 | Lahr | 400/234 X |

FOREIGN PATENT DOCUMENTS

| | | | |
|---|---|---|---|
| 2059943 | 6/1972 | Fed. Rep. of Germany | 400/245 |
| 0071867 | 4/1984 | Japan | 400/249 |

OTHER PUBLICATIONS

IBM Technical Disclosure Bulletin "End-of-Ribbon Sensor and Cartridge-Present Indicator", Jenkins, vol. 27, No. 6, Nov. 1984, pp. 3645-3647.

*Primary Examiner*—Eugene H. Eickholt
*Attorney, Agent, or Firm*—Kenneth R. Glaser

[57] ABSTRACT

A replacement cartridge for replacing spent ink ribbon on a continuous printer. The cartridge interfaces with the printer including a print head past which a document is advanced, a drive for feeding the ribbon tape, and a source of vacuum for effecting vacuum zones in which the feeding tape is buffered against acceleration shock. Included in the cartridge are a supply and takeup reel for the ribbon and between which the ribbon extends in a defined feed path through a pair of tape buffering vacuum chambers upstream and downstream of the print head. Magnets secure the cartridge to the printer at a guided interface in registry with the operative components of the printer. Pre-loading the ribbon in the cartridge entirely threaded throughout its feed path, enables replacement to be performed in a minimum of time requiring only the removal of the spent cartridge and immediately replacing it with the cartridge containing the reload of fresh ribbon.

20 Claims, 4 Drawing Sheets

PRINT RIBBON CARTRIDGE WITH VACUUM BUFFER CHAMBERS

FIELD OF THE INVENTION

The field of art to which the invention pertains comprises the art of printers, more particularly to encoder printers of the type for magnetically encoding continuously moving documents, and even more particularly to improved apparatus for the rapid supply of ink ribbon thereto.

BACKGROUND OF THE INVENTION

High speed document encoders are widely utilized for encoding continuously moving documents. For example, the processing of checks, deposit slips, remittance stubs and similar financial documents normally includes encoder apparatus for magnetically encoding MICR (Magnetic Ink Character Recognition) indicia on these documents. Representing an important component of such encoder apparatus is an operably controlled printer employing an ink ribbon advanced past the print head. The ink ribbon, typically of a pressure transfer type in which, for example, the magnetic ink is transferred to the document, is advanced from a supply reel having a prewound quantity of fresh ribbon thereon through the print head station, and at a rate, synchronized with operation of the printer, and thereafter is wound onto a takeup reel.

Being that the ink on the ribbon is consumable, periodic replacement is required in order to maintain a fresh ribbon supply for operation of the printer. In view of the required speed of the overall document, processing, it is therefore desirable that this ribbon replacement be accomplished as rapidly as possible to avoid undesirable delays in processing; therefore the ribbon supply apparatus should effectively meet such objective. In addition, the rapid movement of the ribbon between supply and takeup requires some type of buffering means for the ribbon, not only to enable such rapid movement, but to absorb ribbon shock during startup and high speed reversals.

BACKGROUND OF THE PRIOR ART

One type of ribbon supply apparatus which has been commonly utilized for continuously supplying fresh quantities of ink ribbon includes rotatable supply and takeup reels typically mounted on the printer without any type of separate enclosure and which are removable or replaceable when the ribbon supply becomes exhausted. Hand threading of the replacement ribbon is then resorted to on-site for, each ribbon replacement in order to properly weave the ribbon in and about the vacuum zones and through the print zone. Such threading is both delicate and time consuming, resulting in equipment downtime each time the ribbon is replaced.

Another type of ribbon supply apparatus uses nonreloadable, disposable cartridges which are devoid of vacuum chamber buffering; and while vacuum chambers, such as those shown in U.S. Pat. No. 4,747,715, have been employed and are known for use as buffer zones for the advancing ribbon, these chambers are typically an integral part of the printer assembly itself.

Thus, the prior art has been largely, ineffective to satisfy the combined need of rapid supply and replacement of ribbon supplies and adequate ribbon buffering.

OBJECTS OF THE INVENTION

It is therefore a principal object of the invention to provide novel and improved apparatus for effecting a fresh ink ribbon replacement in a continuous printer utilizing a vacuum buffer system for the ribbon.

It is a further object of the invention to provide new and improved ink ribbon replacement apparatus for a continuous printer which affords simplified replacement and significantly reduces associated encoder downtime.

It is a still further object of the invention to provide new and improved ribbon supply apparatus in which time consuming ribbon threading during replacement is eliminated.

SUMMARY OF THE INVENTION

The foregoing and additional objects are achieved in accordance with the invention hereof in which the printer ribbon supply apparatus is provided by a replaceable cartridge having the ribbon supply and takeup reels therewith for transporting the fresh ink ribbon past the print head of the printer. Formed integral with the cartridge at intermediate locations in the ribbon path are supply and takeup vacuum buffer chambers, ribbon position vacuum sensor stations, and a vacuum equalizing manifold in communication with the vacuum chambers. Guides on the cartridge cooperate with guides on the printer to ensure operative registration when installed, and in particular to establish communication between a vacuum source associated with the printer assembly and the vacuum chambers and vacuum equalizing manifold of the cartridge.

Being unitized and self contained in this manner, all threading of the ink ribbon can be completed in advance of on-site replacement on the printer. As a consequence, a relatively simple cartridge replacement effects an almost immediate operative replacement of the spent ribbon. Furthermore, with the installation of each cartridge, the vacuum chambers are automatically and instantaneously connected to the vacuum source of the printer; thus, the vacuum buffers are rendered instantly operable.

Since all ribbon threading in the fresh cartridge has been previously prepared, maintenance personnel performing replacement need only be concerned with replacement of the cartridge per se. When compared to previous ribbon replacement procedures, the replacement procedure afforded by the apparatus hereof is greatly simplified and requires minimal time and effort to complete. This results in a significant reduction of equipment downtime occasioned by ribbon replacement representing a fraction of the time previously incurred.

Additional features and advantages of the invention will be appreciated by those skilled in the art upon reading the following detailed description in conjunction with the accompanying drawings.

DESCRIPTION OF THE PREFERRED EMBODIMENT

Figure 1:
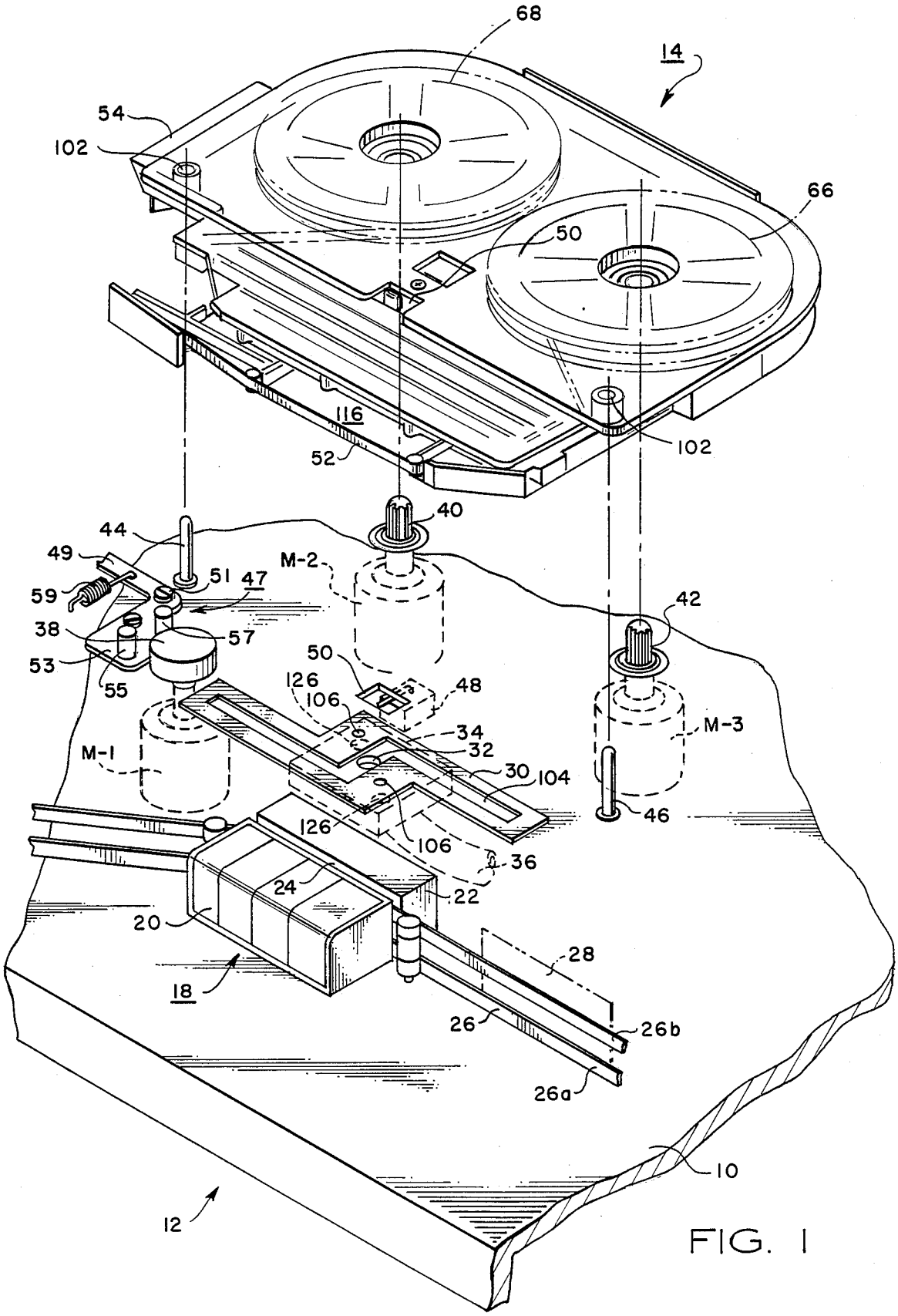
FIG. 1 is a fragmentary isometric view of an encoder printer module with the replacement ribbon cartridge apparatus of the present invention depicted in exploded relation thereto.

In the description which follows, like parts are marked throughout the specification and drawings with the same respective reference numerals. The drawing figures are not necessarily to scale and the proportions of certain parts may have been exaggerated for purposes of clarity.

Referring initially to FIG. 1, a replaceable ribbon cartridge 14 constructed in accordance with the present invention and for supplying an ink ribbon 52 for the printer equipment is adapted for positioning on a surface 10 of an encoder printer module 12. The encoder module 12 may, for example, be of a type commercially marketed by BTI Systems, Inc. of Oklahoma City, Okla. as model number 91690 encoder module. Such module 12 are commonly employed for the encodable imprinting of bank drafts.

The cartridge 14 is adapted for operative coupling of the ribbon 52 with a print head assembly 18 disposed on surface 10, the assembly 18 in a preferred embodiment being formed of a hammer bank 20 and a parallel spaced apart die 22 defining a document transport path or gap 24 therebetween. Conveyor 26, including vertically spaced parallel document drive belts **26*a* and 26*b*, operably advances, at a controlled rate, a document 28 to be imprinted to and through the print head assembly 18 along path 24**.

Figure 4:
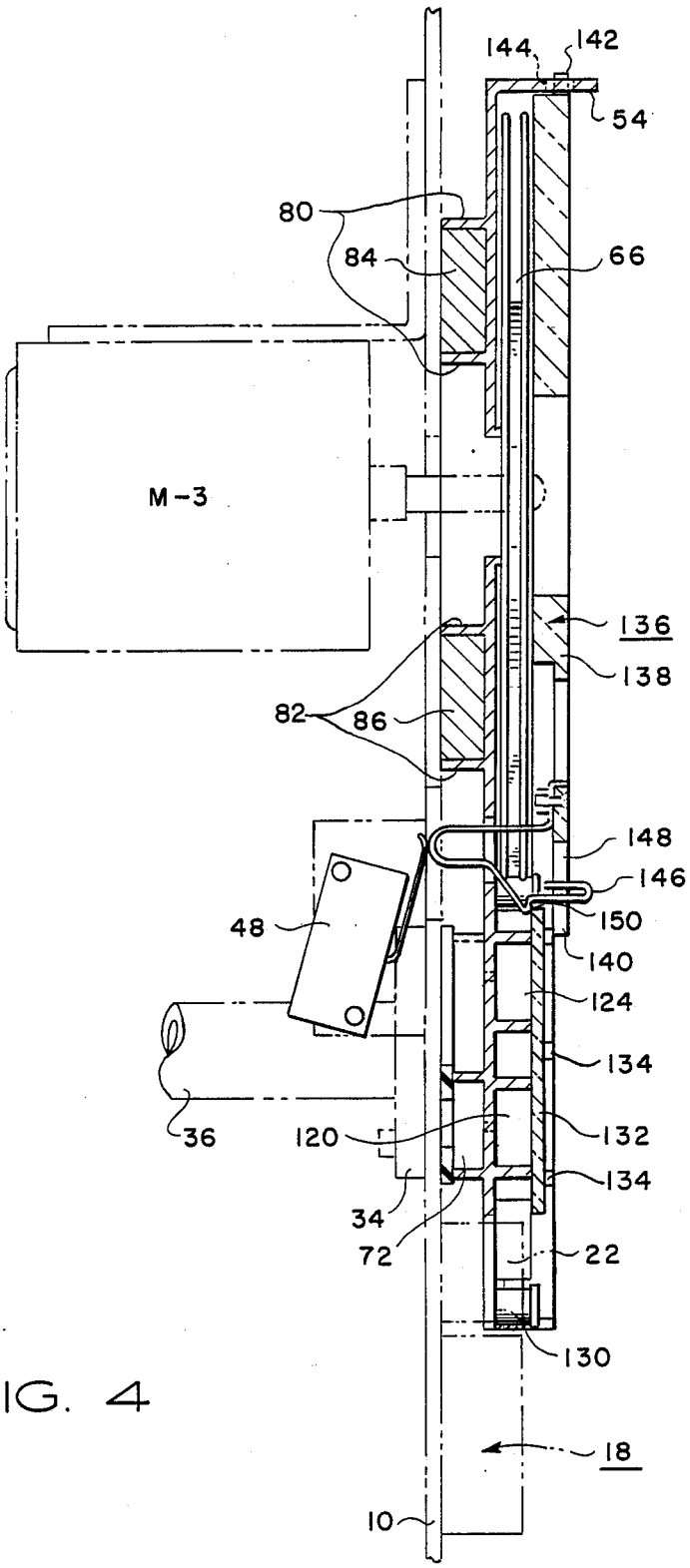
FIG. 4 is a sectional elevation as seen substantially along the lines 4—4 of FIGS. 2 and 3.
Figure 5:
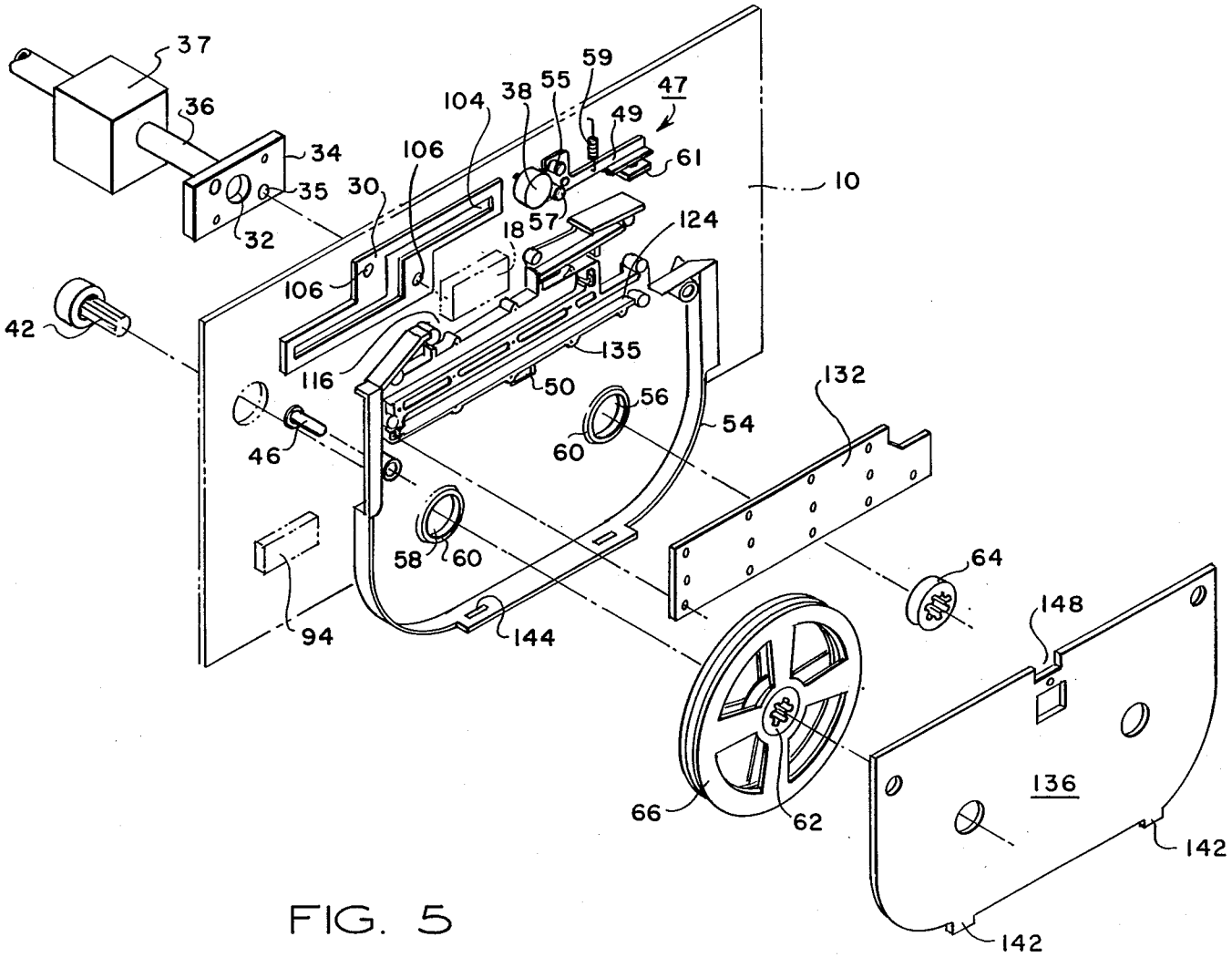
FIG. 5 is an isometric partially exploded view of the cartridge apparatus hereof.

Secured at surface 10 is a gasket 30 overlying enlarged vacuum port 32 and smaller ports 35 (FIG. 5) which are in communication with a vacuum source 37, such as a vacuum pump, by way of hose 36, the port 32 being provided in vacuum block 34. Stepper motors M-1, M-2 and M-3 at the underside of surface 10 are operably controlled to drive ribbon capstan 38 and splined drive spindles 40 and 42 extending through plate 10, and upright spaced locating pins 44 and 46 are provided to extend through openings 102 in the cartridge 14 for installing the cartridge 14 in registry with the encoder module 12. Cartridge 14, when installed in place on surface 10, therefore overlies gasket 30, is guided into desired alignment with the aid of pins 44 and 46, and consequently is effective to position ink ribbon 52 within gap 24 with drive spindles 40 and 42 operably engaging supply and takeup reels 66 and 68 A spring biased ribbon pinch mechanism 47 urges the ribbon 52 against the ribbon capstan 38. Ribbon pinch mechanism 47 includes an L-shaped arm 49 supported on pivot 51 opposite the capstan 38. Arm 49 supports a plate 53 that in turn supports pinch roller bearings 55 and 57 normally urged toward the capstan 38 by tensioned spring 59. Cooperating with mechanism 47 is a ribbon pinch switch 61 (FIG. 5). A cartridge-in-place actuator switch 48 is supported underlying an aperture 50 (FIG. 4) to indicate the presence or absence of a cartridge 14, as will be understood.

Referring more specifically to FIGS. 2–5, cartridge 14 comprises a base 54 of die cast aluminum, for example, having apertures 56 and 58 (FIG. 5), each surrounded by an annular boss 60. Positioned on the bosses 60 about the respective aperture 56 and 58 are splined hubs 62 and 64 for receipt of drive spindles 42 and 40, respectively (FIG. 1). Mounted on the hubs 62 and 64 are a ribbon supply reel 66 and a takeup reel 68, respectively.

Integrally formed on the underside of base 54 (FIG. 3) is an endless, relatively thin and shallow depending wall 70 defining a manifold vacuum chamber 72 joined to contiguous isolated chambers 74 and 76. Each of the chambers 74 and 76 includes a vacuum sensor aperture 78 for purposes as will be described. Formed also along the underside of base 54 beneath the reel area are integral dependent endless walls 80 and 82 defining respective elongated pockets in which there are disposed elongated planar rubber magnets 84 and 86. Magnets 84 and 86 secure the cartridge 14 in place when installed on surface 10. In the area of vacuum manifold 72, there is similarly formed dependent endless walls 88 and 90 likewise defining respective elongated pockets in which to contain elongated planar rubber magnets 92 and 94. A plurality of threaded cylindrical bosses 96 are integrally disposed on an underside base 54 as are angled substantially V-shaped guide walls 98 and 100, each surrounding an aperture 102 for receipt of locating pins 44 and 46.

Wall 70 is relatively thin and dependently shallow at its distal edge for cooperating with gasket 30 in effecting a vacuum seal thereat when the cartridge 14 is installed. Gasket 30 includes a cutout 104 (FIG. 1) conforming to the configuration of manifold 72. Ports 106 in gasket 30 are adapted to communicate the vacuum sensor ports 78 in chambers 74 and 76 with ports 35 in the vacuum block 34. Porous filter media 108 and 110 are disposed in end pockets 112 and 114 of the vacuum manifold 72. A recess 116 is formed in a front portion of base 54 for receipt of print head 18.

Figure 2:
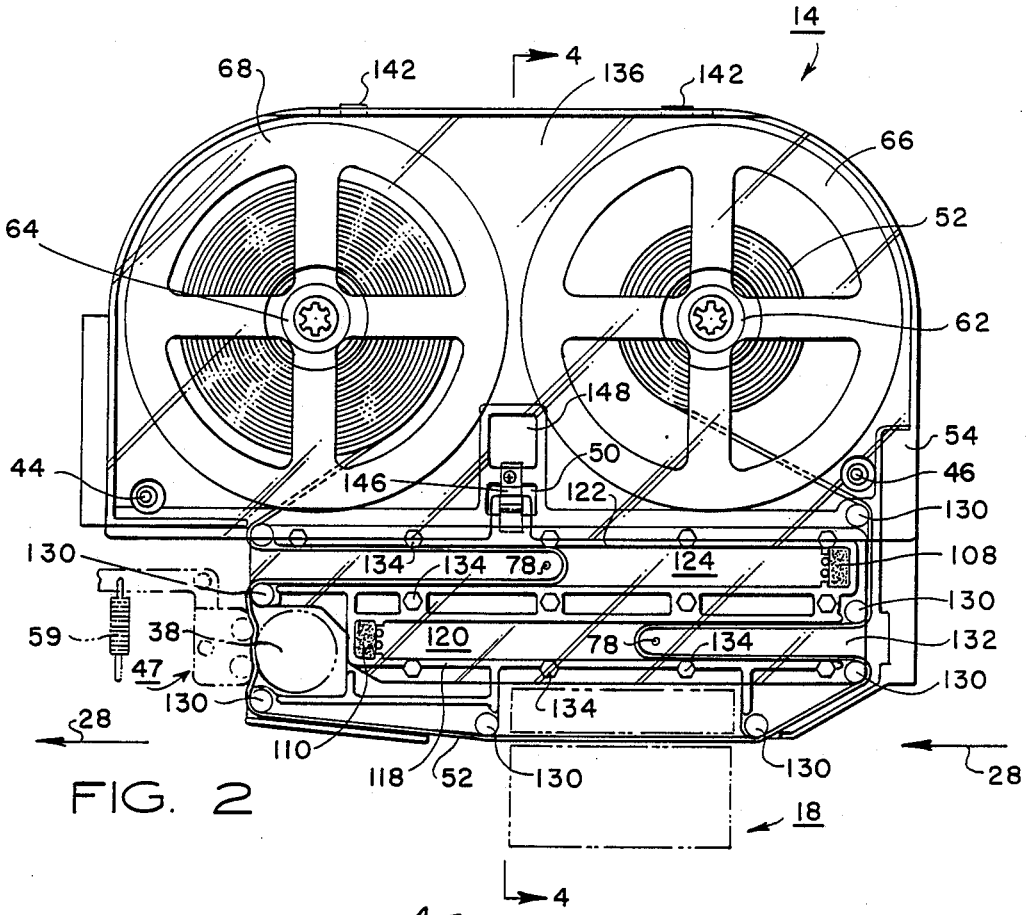
FIG. 2 is a top plan view of the cartridge apparatus of the invention.
Figure 3:
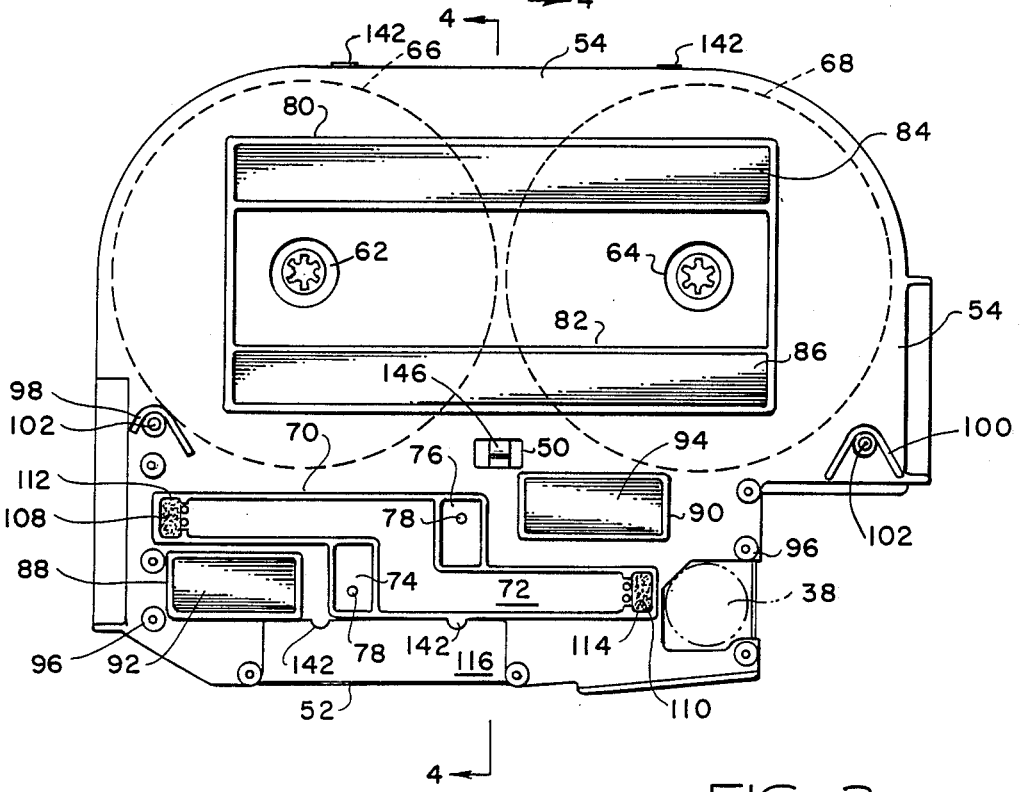
FIG. 3 is a bottom plan view of the cartridge apparatus of the invention.

Referring more specifically to FIG. 2, an upper portion of base 54 includes integral upright walls 118 defining an elongated supply vacuum chamber 120 and integral upright walls 122 defining an elongated takeup vacuum chamber 124. Vacuum for the chambers 120 and 124 is commonly supplied from vacuum manifold, 72 via communication through respective filters 110 and 108 respectively. Being commonly connected with manifold 72, the vacuum level in the respective chambers 120 and 124 is automatically equalized. Located inward of each of the chambers 120 and 124 is the sensor aperture 78, each adapted to be connected on the backside of vacuum block 34 to a vacuum switch 126 (FIG. 1). Threadedly secured to the top side of base 54 for guiding ribbon 52 are a plurality of upstanding cylindrical guide pins 130, each threaded into a boss 96 on the underside.

Mounted overlying the vacuum chambers 120 and 124 to effect substantial enclosure thereof is a first transparent plexiglass cover 132 secured in position thereon by a plurality of screws 134 threaded into tapped apertures 135 in base 54 (FIG. 5). Closely overlying reels 66 and 68 is a second transparent plexiglass cover 136 which includes a central generally thick portion 138 and a relatively thinner peripheral lip portion 140 (FIG. 4). At the upper edge of lip portion 140 (as viewed in FIG. 2) are two spaced-part lateral tabs 142 that extend in an interfit through base apertures 144 for positioning cover 136 in place. Also provided for that purpose is a downwardly depending spring latch 146, attached to cover 136 and having an offset shoulder 150 adapted to latch within aperture 50 to the underside of cover 132. When cartridge 14 is installed in encoder module 12, the latch 146 engages cartridge-in-place actuator switch 48. An enlarged opening 148 enables latch 146 to be hand gripped and released from its latching relation for removal of cover 136 when required to replace ribbon 52.

Ribbon 52, within the foregoing arrangement, is extended in its feed path from supply reel 66 to about a first set of guide pins 130 past supply vacuum chamber 120 to past additional guide pins 130. After passing through recess 116, the ribbon 52 extends over a further set of guide pins 130 past takeup vacuum chamber 124 from which it extends over subsequent guide pins 130 and thence onto takeup reel 68.

In the normal operation of the printer, fresh ribbon 52 is supplied to print head 18 in conjunction with a document 28 being advanced toward the print head 18 by conveyor 26. The supply reel 66 is generally provided with a sufficient quantity of ribbon 52 to run for approximately one hour without interrupting operation of the encoder module 12. To replace ribbon 52, the ribbon pinch mechanism 47 is first pivoted away from capstan 38 to the "load" position. This causes switch 61 to be de-actuated to turn off the vacuum supply and voltage to the stepper motors M-1 M-2, and M-3. The existing cartridge 14 in place on the encoder surface 10 is then lifted off the guide pins 44 and 46 in opposition to the magnetic field of the magnets 84 and 86 urging retention of the cartridge 14 in place.

Customarily, a fresh ribbon cartridge 14 will be retained on site, preloaded with a supply of fresh ribbon 52 completely prethreaded about its feed path. Once the existing cartridge 14 is removed, the replacement cartridge 14 is immediately snapped into position utilizing guide walls 98 and 100 to guide the cartridge apertures 102 onto locating pins 44 and 46. When completely descended on the locating pins 44 and 46 the various undersurfaces on base 54 are caused to seat against surface 10 and gasket 30 thereby placing the cartridge 14 in operative registry with encoder module 12. Via manifold 72 overlying gasket 30, vacuum communication is instantly established by way of port 32 between the vacuum source 37 and the chambers 120 and 124 and through apertures 78 to switches 126. By virtue of the magnets 84 and 86 on the undersurface of the base 54 a secured attachment is effected of the cartridge 14 to the encoder module 12. Simultaneously in replacement, dependent spring latch 146 engages actuator switch 48, which transmits a cartridge-in-place signal to the encoder module 12. With a replacement cartridge on site, the replacement of a cartridge 14 can be completed in a matter of seconds.

Once the replacement cartridge 14 is in place, the arm 49 of ribbon pinch mechanism 47 is pivoted into the "operate" position enabling switch 61 to re-activate the vacuum supply and voltage to the stepper motors M-1, M-2, and M-3. As the vacuum force builds, the ribbon is automatically drawn into the vacuum chambers 120 and 124 while pinch roller bearings 55 and 57 urge the ribbon 52 against ribbon capstan 38.

When operative, vacuum in both chambers 120 and 124 is pulled through the equalizing vacuum manifold 72 from vacuum drawn by vacuum source 37 connected to port 32 via hose 36. As the supply stepper motor M-3 and ribbon capstan 38 advance the ribbon 52, the prepositioned ribbon 52 extending past the vacuum chambers 120 and 124 is looped to a location adjacent vacuum switch apertures 78. The two vacuum switches 126 mounted on surface 10 will communicate with apertures 78 through ports 35 of block 34. Vacuum and sensor seals are maintained by the one piece gasket 30 positioned between the distal edge of walls 70 and surface 10.

As a document 28 advances through the print head 18, ribbon 52 is drawn out of the supply vacuum chamber 120 by operation of stepper motor M-1 and its speed is matched to the document speed by use of the ribbon capstan 38. The takeup vacuum chamber 124 will in turn receive the moving ribbon 52 after it passes through the print head 18. At the completion of printing and as soon as the printed document 28 clears the print head 18, the direction of ribbon 52 is reversed to return as much unused ribbon 52 to the supply chamber 120 as is possible before the next document 28 enters the print head 18 to conserve the supply of ribbon 52. If ribbon 52 is drawn past the vacuum switch aperture 78, such that ribbon 52 is not detected by supply vacuum column switch 126, stepper motor M-3 will be activated to dispense ribbon 52 from supply reel 66 until ribbon 52 is detected by supply vacuum column switch 126.

Under normal conditions, ribbon 52 will remain in takeup chamber 124 looped ahead of the takeup vacuum switch aperture 78 such that the forces of acceleration shock imposed by startup and/or reversal of the ribbon 52 is properly absorbed whereby stress and potential breakage of ribbon 52 is avoided. Should the amount of ribbon 52 within takeup chamber 124 be such that ribbon 52 is detected by takeup vacuum column switch 126, stepper motor M-2 will be activiated to wind excess ribbon 52 onto takeup reel 68 until ribbon 52 is no longer detected by the corresponding switch 126.

By the above description there is disclosed a novel apparatus and method for effecting replacement of ribbon 52 in a high-speed continuous printer. When the replacement of a spent ribbon 52 is to be undertaken, it is only necessary that the cartridge 14 of the spent ribbon 52 be removed from the encoder module 12 in opposition to magnetic forces urging its retention. Immediately thereafter, a replacement cartridge 14 containing a fresh supply of ink ribbon 52 can be inserted in place, enabling operation of the encoder module 12 to be resumed almost immediately. Since threading of ribbon 52 in the replacement cartridge 14 throughout the feed path is not required on-site but is instead previously performed for the preloaded cartridge 14, associated downtime of the encoder module 12 is held to an absolute minimum. The virtues thereof therefore include not only the reduced downtime, of the encoder module 12 but at the same time it lends itself to loading of ribbon 52 on an automated basis performed at a remote location where such facilities are readily available. Whereas, the preferred embodiment of the invention has been described utilizing supply and takeup reels 66 and 68 for the ribbon 52, since the cover 136 retains hubs 62 and 64 in a confined space, reels 66 and 68 can be omitted if desired.

Since many changes could be made in the above construction and many apparently widely different embodiments of this invention could be made without departing from the scope thereof, it is intended that all matter contained in the drawings and specification shall be interpreted as illustrative and not in a limiting sense.

We claim:

1. In a printing apparatus having a print head, first drive means for advancing a document to be imprinted past the print head, second drive means for feeding a supply of consumable ink ribbon past the print head in conjunction with the advance of said document and a vacuum source for buffering said ink ribbon against acceleration shock operationally imposed on said ribbon, the improvement comprising:

a replaceable cartridge detachably mounted on said printing apparatus in operative relation to said print head, said cartridge including:

a base having attachment means for detachably securing said cartridge to said printing apparatus in operative relation to said print head;

a supply member rotatably mounted on said base for receiving a wound quantity of fresh ink ribbon to be advanced in a defined feed path past said print head;

a takeup member rotatably mounted on said base for winding up spent ribbon advanced past said print head;

coupling means for effecting a releaseable drive connection with said second drive means; and a pair of spaced apart vacuum chambers on said base, said chambers being in the defined feed path for receiving said ribbon and being in communication with said vacuum source for buffering said ribbon.

2. In a printing apparatus in accordance with claim 1 wherein one of said vacuum chambers is located between the supply member and print head in the defined feed path and the other of said vacuum chambers is located between the print head and takeup member in the defined feed path.

3. In a printing apparatus in accordance with claim 2 including a vacuum manifold on said base interposed intermediate said vacuum chambers and said vacuum source for equalizing vacuum in each of said vacuum chambers.

4. In a printing apparatus in accordance with claim 2, including a quantity of ink ribbon threaded along said feed path from said supply member, through said print head and vacuum chambers and onto said takeup member.

5. In a printing apparatus in accordance with claim 4 in which said ink ribbon is pre-threaded in said feed path while said cartridge is detached from said printing apparatus.

6. In a printing apparatus in accordance with claim 4 including ribbon sensor means communicating with said vacuum chambers for transmitting ribbon positioning information to said printing apparatus.

7. In a printing apparatus in accordance with claim 1 wherein said attachment means includes a plurality of magnets on an underside of said base for effecting magnetic attachment to a recipient surface of said printing apparatus.

8. In a printing apparatus in accordance with claim 7 in which said base is of a cast construction and said vacuum chambers are defined by upright walls depending from an upper surface of said base and cover means cooperating with said walls in overlying relation thereto.

9. In a printing apparatus in accordance with claim 7 in which said printing apparatus includes a cartridge-in-place actuator switch, and said cartridge includes a switch actuator to operatively actuate said actuator switch for signaling when said cartridge is in said operative relation with said print head.

10. In a printing apparatus in accordance with claim 8, including ribbon sensor means and a port connecting said ribbon sensor means with said vacuum chambers for detecting ribbon position within the chambers.

11. A replaceable cartridge for supplying an ink ribbon to a printing apparatus having a print head, a vacuum source for buffering the ink ribbon and drive means for advancing the ink ribbon concomitantly with operation of the print head, said cartridge comprising;

a base having attachment means for detachably securing said cartridge to said printing apparatus in operative relation with the print head;

a supply member rotatably mounted on said base for receiving a wound quantity of fresh ink ribbon to be advanced in a defined feed path past said print head;

a takeup member rotatably mounted on said base for winding up spent ribbon advanced past said print head;

coupling means for effecting a releaseable drive connection with said drive means; and a pair of spaced apart vacuum chambers on said base, said chambers being in the defined feed path for receiving said ribbon and being in communication with said vacuum source for vacuum buffering said ribbon.

12. A cartridge in accordance with claim 11 in which said vacuum chambers are spaced apart in said feed path for receiving said print head operatively intervening therebetween.

13. A cartridge in accordance with claim 11 including a vacuum manifold on said base in communication with each of said vacuum chambers for being connected to said vacuum source intermediate said vacuum chambers and said vacuum source.

14. A cartridge in accordance with claim 11, including a quantity of ink ribbon operatively extending along said feed path from said supply member, through said vacuum chambers and said print head and onto said takeup member.

15. A cartridge in accordance with claim 11 in which said attachment means includes a plurality of magnets on an underside of said base for effecting magnetic attachment to a recipient surface of the printing apparatus.

16. A cartridge in accordance with claim 15 in which said base is of a cast construction and said vacuum chambers are defined by upright walls depending from an upper surface of said base and cover means cooperating with said walls in overlying relation thereto.

17. A cartridge in accordance with claim 15 in which said printing apparatus includes a cartridge-in-place actuator switch, and there is included a switch actuator to operatively actuate said actuator switch for signaling when the cartridge is in said operative relation with said print head.

18. A cartridge in accordance with claim 11 including port means within said vacuum chambers for communicating with a ribbon sensor to transmit ribbon positioning information to the printer apparatus with which the cartridge is utilized.

19. A method of replacing a supply of spent ink ribbon in a printing apparatus having a print head, first drive means for advancing a document to be imprinted past the print head, second drive means for feeding the ink ribbon past the print head in conjunction with the advancement of the document and a vacuum source for locally buffering the ink ribbon against imposed acceleration shock, said method comprising the steps of:

providing a replaceable cartridge for being detachably mounted on the printing apparatus, said cartridge including:

a rotatable supply member for receiving a wound quantity of fresh ink ribbon to be advanced in a defined feed path past the print head;

a rotatable takeup member for receiving spent ribbon; and a pair of vacuum chambers disposed in the defined feed path of the ribbon, intermediate said supply member and said takeup member;

providing a predetermined quantity of fresh ribbon on said supply member and threading said ribbon along said feed path from said supply member, through said vacuum chambers and onto said takeup member; and mounting said cartridge on the printing apparatus in operative relation to said print head, said drive means and said vacuum source.

20. In combination with printing apparatus having a print head, first drive means for advancing a document to be imprinted past the print head, second drive means for feeding a supply of ribbon past the print head, and a vacuum source, the improvement comprising:

a replaceable cartridge detachably mounted on said printing apparatus in operative relation to said print head, said cartridge including:

a supply member rotatably mounted for receiving a wound quantity of fresh ink ribbon to be advanced in a defined feed path past said print head;

a takeup member rotatably mounted for winding up spent ribbon received from said print head;

coupling means for effecting a releaseable drive connection with said second drive means;

a pair of spaced part vacuum chambers in said defined feed path for buffering said ribbon; and means for detachably securing said cartridge to said printing apparatus, such that said vacuum chambers are in communication with said vacuum source.

* * * * *